US005225635A

United States Patent [19]

Wake et al.

[11] Patent Number: 5,225,635

[45] Date of Patent: Jul. 6, 1993

[54] HERMETIC LEAD WIRE

[75] Inventors: Travis C. Wake, Centerville; Ronald S. May, Richmond, both of Ind.

[73] Assignee: Cooper Industries, Inc., Houston, Tex.

[21] Appl. No.: 790,632

[22] Filed: Nov. 8, 1991

[51] Int. Cl.[5] ..... H01B 7/00

[52] U.S. Cl. ..... 174/110 PM; 174/110 AR; 174/120 R; 174/120 SR; 174/120 AR

[58] Field of Search .... 174/110 AR, 110 V, 110 PM, 174/120 R, 120 SR, 120 AR

[56] References Cited

U.S. PATENT DOCUMENTS

| | | | |
|---|---|---|---|
| 3,206.542 | 9/1965 | Dawson et al. | 174/120 R |
| 3,909.507 | 9/1975 | Betts et al. | 174/120 SR |
| 3,911,202 | 10/1975 | Stine et al. | 174/120 SR |
| 3,925,597 | 12/1975 | Misiura et al. | 174/120 SR |
| 3,971,882 | 7/1976 | Alia | 174/110 SR |
| 4,041,237 | 8/1977 | Stine et al. | 174/110 PM |
| 4,045,611 | 8/1977 | Torgerson | 174/110 PM |
| 4,125,509 | 11/1978 | Vostovich | 174/110 AR |
| 4,145,475 | 3/1979 | Vostovich | 174/110 PM |
| 5,106,686 | 4/1992 | Wade, Jr. et al. | 174/110 SR |

*Primary Examiner*—Morris H. Nimmo

*Attorney, Agent, or Firm*—Laff, Whitesel, Conte & Saret

[57] ABSTRACT

A hermetic lead wire having an extruded chlorosulfonated polyethylene insulation wherein the insulation also contains an acid acceptor, filler and peroxide cross-linking agent. The insulation composition and a method of preparing the insulation composition by first blending the chlorosulfonated polyethylene with the acid acceptor and then adding a filler and peroxide cross-linking agent.

11 Claims, 1 Drawing Sheet

HERMETIC LEAD WIRE

FIELD OF THE INVENTION

This invention relates to a hermetic lead wire used in hermetically sealed electrical apparatus such as a refrigeration system, an extrudable composition to insulate the electrical conductor, and a method of preparing the extrudable composition. More particularly, the invention relates to a hermetic lead wire having extruded thereon an electrical insulating chlorosulfonated polyethylene layer, the chlorosulfonated polyethylene composition used to form the insulation and a method of preparing the composition.

BACKGROUND OF THE INVENTION

Hermetic lead wires used in refrigeration systems are exposed directly to the refrigerant fluid such as liquid and/or gaseous freon. The motors in the system usually vibrate and cause the lead wires to also vibrate. Therefore, it is important that the lead wires be capable of withstanding the vibration and also t withstand deterioration from the refrigerant fluid as well as various compressor motor oils.

The conventional hermetic lead wire which is generally used is formed with a multi-stranded conductor for conducting the electricity and has multi-layered insulation.

The multi-layered insulation generally has a first polyester fiber braid cover over the multi-stranded conductor. The polyester fiber braid is wrapped with polyester tape. The outer layer is a braided polyester fiber sheath.

Our U.S. Pat. No. 4,045,611 provides a hermetic lead wire which eliminated the first inner polyester fiber sleeve of the conventional hermetic lead wire. Our patent utilized for the inner layer a thin foil-like layer of non-woven polyester fibers.

While the conventional hermetic lead wires and the improved lead wire of our U.S. Pat. No. 4,045,611 are generally satisfactory, the braiding process is a relatively slow process. Also, it is difficult to maintain quality control due to undetected tape folds. Loose or tight polyester fiber braids cause customer stripping problems and also tend to provide a relatively large amount of scrap material.

SUMMARY OF THE INVENTION

It is therefore an object of the present invention to eliminate the use of any braiding and to provide a hermetic motor lead wire which has an extruded electrical insulating chlorosulfonated polyethylene coating position thereon.

It is another object of the present invention to provide a hermetic lead wire extrudable insulating composition containing chlorosulfonated polyethylene, an acid acceptor, a filler and peroxide cross-linking agent.

Also, a further object of the present invention is to provide a method of preparing the chlorosulfonated composition by first mixing chlorosulfonated polyethylene and an acid acceptor and then adding a filler and peroxide cross-linking agent.

Other objects and advantages of the invention will become apparent from the following detailed description taken in conjunction with the drawings.

DETAILED DESCRIPTION OF THE INVENTION

Figure 1:
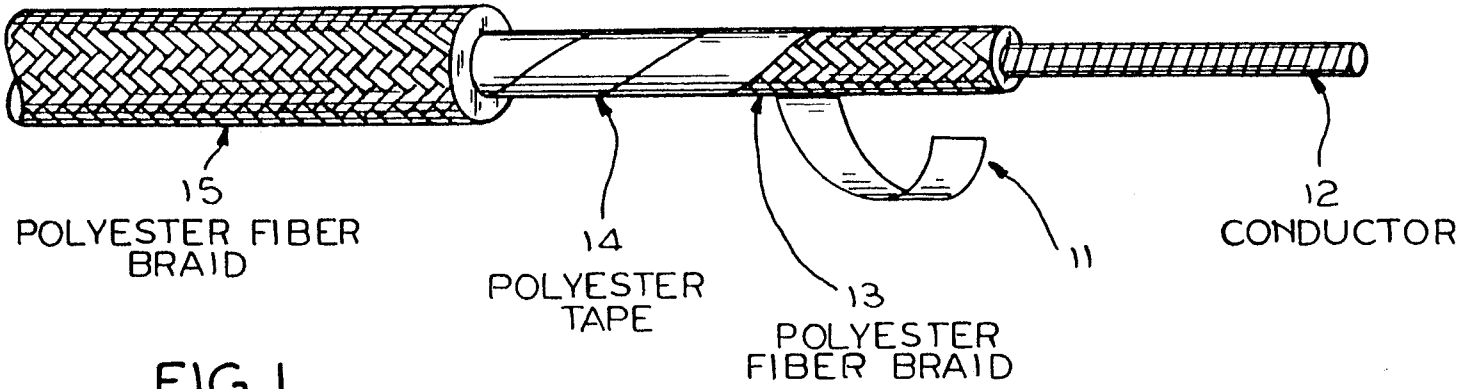
FIG. 1 (PRIOR ART)
FIG. 1 is a perspective view of a hermetic lead wire constructed in accordance with the prior art.

Referring to FIG. 1, there is shown a hermetic lead wire 11 of the prior art. The hermetic lead wire 11 has a conductor 12. The conductor 12 is a stranded metallic conductor which is either bare or coated. The coating may be selected from appropriate metals such as tin, silver, and/or nickel.

The conductor 12 has an inner braided polyester sheath 13. Over the inner braided polyester fiber sheath 13 is spirally wrapped polyester insulating tape 14. An outer polyester fiber sheath 15 is braided over the insulating polyester tape 14. The braiding is usually done by a conventional braiding machine and is usually done at very slow speeds of less than 10 feet per minute.

Figure 2:
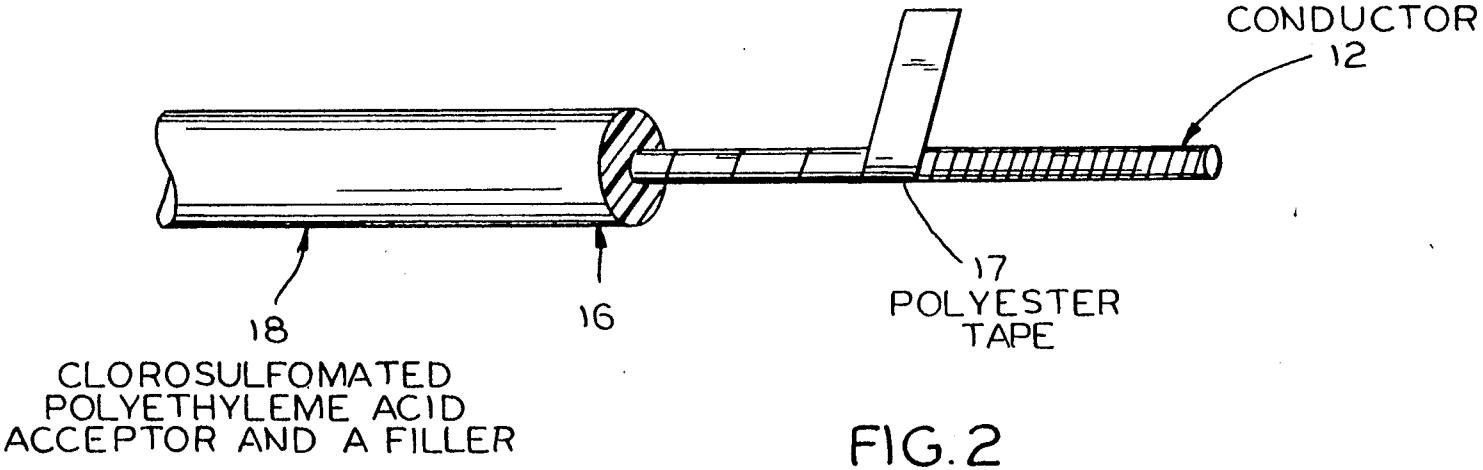
FIG. 2 is a perspective view of a hermetic lead wire constructed in accordance with the preferred embodiment of the invention.

The hermetic lead wire 16 of the present invention is shown in FIG. 2. The improved hermetic lead wire 16 is formed with a first layer of spiral or laterally applied polyester tape as separator, or with an insulation release or with a color coded identification tape 17.

An insulation coating, layer or jacket 18 is extruded over the coated or wrap stranded conductor 12. The insulation layer extruded over such conductor 12 provides vibration resistance, flexibility, resistance to various liquid or gaseous freons as well as various compressor motor oils and combinations thereof.

The extrusion layer 18 is typically applied at extrusion speeds of 300 feet per minute and substantially eliminates the problems of loose or tight braids and electrical failures due to bad taping operations.

The extrusion coating 18 is an extrudable chlorosulfonated polyethylene composition. Preferably, the composition is a thermosetting chlorosulfonated polyethylene composition containing chlorosulfonated polyethylene elastomer, an acid acceptor, a filler, a curing agent, and if desired, a lubricant processing aid.

The chlorosulfonated polyethylene elastomer was purchased as Hypalon® 40S produced by DuPont. The acid acceptor is preferably magnesium oxide and the amount of magnesium oxide per 100 parts by weight of the Hypalon is in the range of about 30 to about 62 parts by weight. The filler is preferably an electrical insulating filler such as anhydrous aluminum silicate and this is preferably used in the range of about 40 to about 70 parts by weight per 100 parts by weight of Hypalon. The curing agent is generally organic peroxides and are used in the range of about 5.0 to about 10.0 parts per weight per 100 parts by weight of Hypalon.

Also, we have found that when we add lubricant processing aid to the above composition, we provide a more beneficial hermetic lead wire. The lubricant processing aid, preferably is a ground tetrafluoroethylene polymer purchased from Rhein-Chemie. The coating composition is placed in an appropriate extruder and extruded onto a stranded conductor which may have been wrapped with polyester tape.

As stated above, the well known stranded conductors for hermetic lead wires which may have the strands coated with tin, silver, and/or nickel.

The coating composition is preferably prepared by first preparing a blend of Hypalon 40S and magnesium oxide. The blended Hypalon and magnesium oxide is then combined with the filler, curing agent and, if desired, lubricating aid and this mixture is fed to the extruder.

The polyester tape 17 in the present invention may be eliminated totally and the stranded conductor 12 may have extruded directly thereon the chlorosulfonated polyethylene layer or jacket 18.

However, in another embodiment of the present invention, a release agent may be utilized with or without the polyester tape 17. The release agent is coated onto the stranded conductor 12. If desired, release coating may be applied before or after the polyester tape is applied. The release coating is preferably selected from fluorocarbon release agents. The release agents we use are C-189-11 which is an aqueous solution of polytetrafluoroethylene polymer purchased from Standard Technical Applied Resources of Linden, N.J., or a Vydax solution which is approximately 2–3 parts by weight of Fluorotelomer dispersion and 50 parts by weight of Freon TF Solvent. The Vydax solution components were purchased from E.I. DuPont-De-Nemours and Company. The typical sizes of hermetic lead wires 16 range from 20 AWG to 4 AWG. Of course, other size hermetic lead wires may be constructed in accordance with the principles of the present invention. By way of example, and not a limitation of the present invention, a hermetic lead wire of 16 AWG has been constructed. The central stranded conductor wire 12 has a diameter of 0.060 inches. A release coating was applied on the stranded conductor 12. The coated conductor was fed to an extruding machine which was supplied with a chlorosulfonated polyethylene composition. This composition was prepared by mixing about 53.7 parts by weight of anhydrous aluminum silicate, about 8.4 parts by weight of the organic peroxide curing agents, and about 0.71 parts by weight of ground Teflon with a blend of about 100 parts by weight Hypalon and about 42 parts by weight of magnesium oxide.

The composition was blended on a 60 inch mill and fed to the extruder where it was heated and extruded onto the coated conductor. The outer layer 18 of the polychlorosulfonated polyethylene composition was such to provide a hermetic lead wire 16 with an outer diameter of 0.122 inches. Dielectric breakdown strength of this hermetic lead wire 16 of 16 AWG gauge was found to be in excess of 19,000 volts. The above hermetic lead wire does not contaminate the freon air conditioning fluid and also provides a hermetic lead wire which can be produced in a more economical manner.

While applicant has shown preferred embodiments of their invention, it will be understood that there is no intent to limit the invention by the preferred embodiments of the disclosure. Rather, this was for illustration purposes and it is intended to cover all reasonable alternate embodiments which fall within the spirit and scope of the invention as defined in the appended claims.

We claim:

1. A hermetic lead wire for use in hermetically sealed electrical apparatus comprising:

an electrical conductor having thereon an extruded layer of an electrical insulating composition having about 100 parts by weight of an chlorosulfonated polyethylene, from about 30 to about 62 parts by weight of said acid acceptor and from about 40 to about 70 parts by weight of a filler.

2. The hermetic lead wire of claim 1 wherein the composition includes from about 5 to about 10 parts by weight of a curing agent and from about 0.5 to about 1.0 parts by weight of a lubricant aid.

3. The hermetic lead wire of claim 2 wherein said conductor is a plurality of longitudinally extending metallic strands and there is a spiral or laterally applied polyester tape between the conductor and the extruded layer.

4. The hermetic lead wire of claim 2 wherein said conductor is a plurality of longitudinally extending metallic strands and there is a release coating applied between the conductor and the extended layer.

5. The hermetic lead wire of claim 1 wherein the acid acceptor is magnesium oxide and the filler is anhydrous aluminum silicate.

6. A hermetic lead wire for use in hermetically sealed electrical apparatus comprising:

an electrical conductor having thereon an extruded layer of an electrical insulating composition which comprises chlorosulfonated polyethylene, an acid acceptor and a filler; wherein the acid acceptor is magnesium oxide and the filler is anhydrous aluminum silicate.

7. A hermetic lead wire for use in hermetically sealed electrical apparatus comprising:

an electrical conductor having thereon an extruded layer of an electrical insulating composition which comprises chlorosulfonated polyethylene, an acid acceptor, a filler, a curing agent and a lubricant aid wherein the acid acceptor is magnesium oxide and the filler is anhydrous aluminum silicate.

8. The hermetic lead wire of claim 7 wherein the curing agent is an organic peroxide and the lubricant aid is a ground tetrafluoroethylene polymer.

9. The hermetic lead wire of claim 8 wherein said conductor is a plurality of longitudinally extending metallic strands and there is a spiral or laterally applied polyester tape between the conductor and the extruded layer.

10. The hermetic lead wire of claim 8 wherein said conductor is a plurality of longitudinally extending metallic strands and there is a release coating applied between the conductor and the extruded layer.

11. A hermetic lead wire comprising:

a multi-stranded metallic conductor, a polyester tape wrapped around said conductor, and a top extruded layer of a chlorosulfonated polyethylene which was extruded from a composition comprising about 100 parts by weight chlorosulfonated polyethylene, from about 30 to about 62 parts by weight magnesium oxide, from about 40 to about 70 parts by weight anhydrous aluminum silicate, from about 5 to about 10 parts by weight organic peroxide and from about 0.5 to about 1.0 parts by weight ground tetrafluoroethylene polymer.

* * * * *